US008800902B2

(12) United States Patent
Ko

(10) Patent No.: US 8,800,902 B2
(45) Date of Patent: Aug. 12, 2014

(54) ATTACHMENT WITH INTERCHANGEABLE JAW

(76) Inventor: Seung Hwan Ko, Incheon (KR)

( * ) Notice: Subject to any disclaimer, the term of this patent is extended or adjusted under 35 U.S.C. 154(b) by 0 days.

(21) Appl. No.: 13/488,100

(22) Filed: Jun. 4, 2012

(65) Prior Publication Data

US 2013/0320122 A1 Dec. 5, 2013

(51) Int. Cl.

| | |
|---|---|
| ***B02C 19/00*** | (2006.01) |
| ***B02C 1/08*** | (2006.01) |
| ***E02F 3/96*** | (2006.01) |
| ***B02C 1/02*** | (2006.01) |
| ***E02F 3/36*** | (2006.01) |

(52) U.S. Cl.

CPC . *B02C 1/02* (2013.01); *E02F 3/965* (2013.01); *E02F 3/3663* (2013.01); *E02F 3/3636* (2013.01)

USPC ..... 241/101.72; 241/266; 241/101.73

(58) Field of Classification Search

USPC ..... 241/101.73, 266, 101.72; 83/609; 30/134

See application file for complete search history.

(56) References Cited

U.S. PATENT DOCUMENTS

| | | | | | |
|---|---|---|---|---|---|
| 4,403,431 | A * | 9/1983 | Ramun et al. | 37/406 |
| 4,450,625 | A * | 5/1984 | Ramun et al. | 30/134 |
| 4,512,524 | A * | 4/1985 | Shigemizu | 241/101.73 |
| 4,670,983 | A * | 6/1987 | Ramun et al. | 30/134 |
| 4,697,509 | A * | 10/1987 | LaBounty | 100/233 |
| 4,838,493 | A * | 6/1989 | LaBounty | 241/101.73 |
| 4,951,886 | A * | 8/1990 | Berto | 241/101.73 |
| 5,044,569 | A * | 9/1991 | LaBounty et al. | 241/266 |
| 5,060,378 | A * | 10/1991 | LaBounty et al. | 30/134 |
| 5,062,227 | A * | 11/1991 | De Gier et al. | 37/406 |
| 5,187,868 | A * | 2/1993 | Hall | 30/134 |
| 5,230,151 | A * | 7/1993 | Kunzman et al. | 30/134 |
| 5,671,892 | A * | 9/1997 | Morikawa et al. | 241/101.73 |
| 5,992,023 | A * | 11/1999 | Sederberg et al. | 30/134 |
| 6,298,560 | B1 * | 10/2001 | Lee | 30/134 |
| 6,655,054 | B1 * | 12/2003 | Ward | 37/406 |
| 7,284,718 | B2 * | 10/2007 | Christenson | 241/101.73 |

* cited by examiner

*Primary Examiner* — Faye Francis

(74) *Attorney, Agent, or Firm* — John K. Park; Park Law Firm

(57) ABSTRACT

The invention relate to an attachment with interchangeable jaws, in which jaws can be interchanged according to the work purpose in the use of the attachment attached to construction equipment such as an excavator and configured to crush or shear concrete or reinforcing bars. The attachment comprises a main body unit connected to heavy construction equipment, and a jaw unit connected to the main body unit. The main body unit comprises a pair of lock pins, and at least one operating cylinder. The lock pins and the least one operating cylinder are mounted on a main body unit frame. The main body unit frame comprises an equipment connecting section, a first support, a second support, and a hook pin-receiving portion. The jaw unit comprises a pair of jaws, a jaw pin, and a hook pin. The jaw unit frame comprises a third support.

2 Claims, 7 Drawing Sheets

ATTACHMENT WITH INTERCHANGEABLE JAW

BACKGROUND OF THE INVENTION

1. Field of the Invention

The present invention relate to an attachment with interchangeable jaws, and more particularly, to such an attachment in which jaws can be interchanged according to the work purpose in the use of the attachment attached to construction equipment such as an excavator and configured to crush or shear concrete or reinforcing bars.

2. Background of the Related Art

In general, for heavy construction equipment such as an excavator, a bucket for excavation, a crusher for crushing concrete and the like, and a shear for cutting reinforcing bars or iron plates are selectively used according to the work purpose thereof. In a place such as a site where a building is demolished, the frequent replacement between the crusher and the shear is very burdensome, and thus as disclosed in Korean Patent Registration No. 1004188640000 entitled "Processor of a Construction Apparatus for Destroying Concrete Structures and Cutting Steel Reinforcing Rods" of the applicant of the present invention, an attachment which can perform a crushing and shearing operation has been proposed. In addition, in many cases, such an attachment has a considerable weight and employs a quick coupler configured to be easily mounted on heavy construction equipment.

Meanwhile, the crusher and the shear have a common feature in that they are operated using jaws activated by a hydraulic cylinder. In addition, the crusher and the shear are distinguished from the bucket that does not include a separate mechanical link by itself. That is, the attachment can be used as a crusher when adopting jaws attached with spikes, and can be used as a shear when adopting jaws attached with blades.

Like this, for the sake of convenience of use, an attachment with interchangeable jaws are recently released, and an excavator demolition attachment with interchangeable jaw assemblies disclosed in U.S. Pat. No. 7,284,718 can be given as a representative example of the attachment.

FIGS. 1 to 4 are views for explaining the conventional prior art as described above, wherein FIG. 1 is a perspective view illustrating an outer appearance of an attachment, FIG. 2 are perspective views illustrating a main body unit and a jaw unit of the attachment, FIG. 3 is a conceptual view illustrating a process in which the jaw unit is engaged with the main body unit, and FIG. 4 is a perspective view illustrating the engagement relationship between the main body unit and the jaw unit.

As shown in FIG. 1 and, an attachment having interchangeable jaws includes a main body unit 100 joined to a front end of an arm of an excavator, and a jaw unit 200 mounted to the main body unit 100 and configured to be interchangeable. The main body unit 100 is provided with an operating cylinder 110 which is activated by being supplied with oil pressure from heavy construction equipment. In addition, the jaw unit 200 includes a pair of jaws, i.e., a lower jaw 210 and an upper jaw 220, which are pivotally interconnected with each other by a jaw pin 230. The attachment is used as a shear when the jaw unit whose each jaw may be attached with a blade 240 is mounted thereon, and may be used as a crushed when the jaw unit attached with or formed with spikes 250 is mounted thereon.

Further, the main body unit 100 includes a lock pin 120 that is moved in an extendable and retractable manner by oil pressure, and a hook pin-receiving portion 130 in the form of an open slot. The jaw unit 200 includes an insertion hole 260 so as to allow the lock pin 120 to be inserted thereto, and a hook pin 270 hooked in the hook pin-receiving portion 130.

In FIG. 3, there is shown a conceptual view illustrating a process in which the jaw unit 200 is engaged with the main body unit 100.

First, as shown in FIG. 3(*a*), the main body unit 100 is moved to approach the jaw unit 200, and the hook pin 270 is then insertedly hooked in the hook pin-receiving portion 130 (see FIG. 3(*b*)). Thereafter, the main body unit is pivotally rotated to align the centers of the lock pin 120 and the insertion hole 260 with each other, and then the lock pin 120 is extended into the insertion hole 260 to lock the jaw unit 200 to the main body unit 100 (see FIG. 3(*c*)). Then, when the operating cylinder 110 is connected to an operating cylinder connecting section 280 of the jaw unit 200, the interchange of the jaw unit is completed (see FIG. 3(*d*)).

FIG. 4 shows the operation of the lock pin for maintaining the engagement relationship between the main body unit and the jaw unit.

In the prior art, the lock pin is constructed in such a fashion that a lock pin cylinder 122 is moved in an extendable and retractable manner. That is, FIG. 4(*a*) shows a state in which the lock pin cylinder 122 is not inserted into the insertion hole 260 of the jaw unit 200, and FIG. 4(*a*) shows a state in which the lock pin cylinder 122 is moved to be inserted into the insertion hole 260 of the jaw unit 200.

However, the attachment according to the prior art as described above entails a problem in that since the lock pin 120 is provided only in a single number, it is frequently broken or damaged during the work. In addition, the conventional attachment encounters a drawback in that the lock pin 120 is fixed only at a central portion thereof to the main body unit, and thus the lock pin 120 is in a loosened state and is deviated from a normal position by vibration applied thereto during the movement of the heavy construction equipment, which makes it difficult to insert the lock pin into the insertion hole when the jaw unit 200 is locked to the main body unit 100.

Moreover, as shown in conceptual views of magnified circular portions indicated by a dotted line in FIG. 4, the lock pin 120 bears a work load while in use with it inserted into the main body unit 100 and the jaw unit 200. In this case, the lock pin cylinder 122 is deformed by the work load, so that an excessive load is exerted between the lock pin cylinder 122 and a lock pin piston 123, thereby resulting in deformation and abrasion of the lock pin. Furthermore, such a conventional attachment involves a shortcoming in that when eccentricity occurs upon the insertion of a front end of the lock pin cylinder 122 into the insertion hole 260, and thus a front end of the lock pin, i.e., the front end of the lock pin cylinder 122 in the prior art is deformed or damaged, the lock pin cylinder must be replaced in its entirety.

SUMMARY OF THE INVENTION

Accordingly, the present invention has been made in order to solve the above-mentioned problems occurring in the prior art, and it is an object of the present invention to provide an attachment having interchangeable jaws, which can prevent a load from being exerted to a hook pin during the operation of the attachment after replacement of jaws, can allow a lock pin to endure its self-weight, can guide the extendable and retractable movement of the lock pin, and can allow only the lock pin stop to be replaced with new one even though the front end of the lock pin is abraded.

To achieve the above objects, in accordance with a preferred embodiment, the present invention provides an attachment having interchangeable jaws, including:

a main body unit connected to heavy construction equipment; and a jaw unit connected to the main body unit, wherein the main body unit includes: a pair of lock pins configured to be moved in an extendable and retractable manner by being supplied with oil pressure from the construction heavy equipment, each of the locking pins including a lock pin stop mounted at both ends thereof; and at least one operating cylinder configured to operate the jaw unit by being supplied with oil pressure from the construction heavy equipment, the lock pins and the least one operating cylinder being mounted on a main body unit frame, wherein the main body unit frame includes an equipment connecting section configured for connection with the construction heavy equipment, a first support configured to support the lock pin stop when the lock pins are retracted, a second support configured to support the lock pin stop or the lock pin piston when the lock pins are extended, and a hook pin-receiving portion formed at one side of the main body unit frame, wherein the jaw unit includes: a pair of jaws, each of which includes an operating cylinder connecting section formed at one side thereof for connection with the operating cylinder and a blade or spike formed at the other side thereof; a jaw pin configured to support the pivotal rotation of the jaws; and a hook pin engagingly mounted to a jaw unit frame so as to be insertedly hooked in the hook pin-receiving portion, and wherein the jaw unit frame includes a third support interposed between the first and second supports and having a pair of insertion holes formed therein so as to allow the pair of lock pins to be inserted thereto, respectively.

Preferably, the lock pin stop may include an inclined face partially formed at a peripheral edge of an outer end thereof, which is opposed to an inner end thereof joined to the lock pin piston.

BRIEF DESCRIPTION OF THE DRAWINGS

The above and other objects, features and advantages of the present invention will be apparent from the following detailed description of the preferred embodiments of the invention in conjunction with the accompanying drawings, in which.

| [Explanation on symbols] | |
|---|---|
| 100: main body unit | 101: main body unit frame |
| 102: equipment connecting section | 103: first support |
| 104: second support | 105: lock pin support |
| 110: operating cylinder | 120: lock pin |
| 122: lock pin cylinder | 123: lock pin piston |
| 124: lock pin stop | 125: inclined face |
| 130: hook pin-receiving portion | 200: jaw unit |
| 201: jaw unit frame | 202: third support |
| 210, 220: jaw | 230: jaw pin |
| 240: blade | 250: spike |
| 260: insertion hole | 270: hook pin |
| 280: operating cylinder connecting section | |

DETAILED DESCRIPTION OF THE PREFERRED EMBODIMENTS

Reference will be now made in detail to preferred embodiments of the present invention with reference to the attached drawings. In the following description, the detailed description on known function and constructions unnecessarily obscuring the subject matter of the present invention will be avoided hereinafter. Also, the terms used herein are defined in consideration of the function of the present invention, which may vary according to an intention of a user or an operator or according to custom. Thus, definition of such terms should be made based on content throughout the specification disclosing an attachment having interchangeable jaws according to the present invention.

Now, a preferred embodiment of the present invention will be described hereinafter in more detail with reference to the accompanying drawings.

Figure 5:
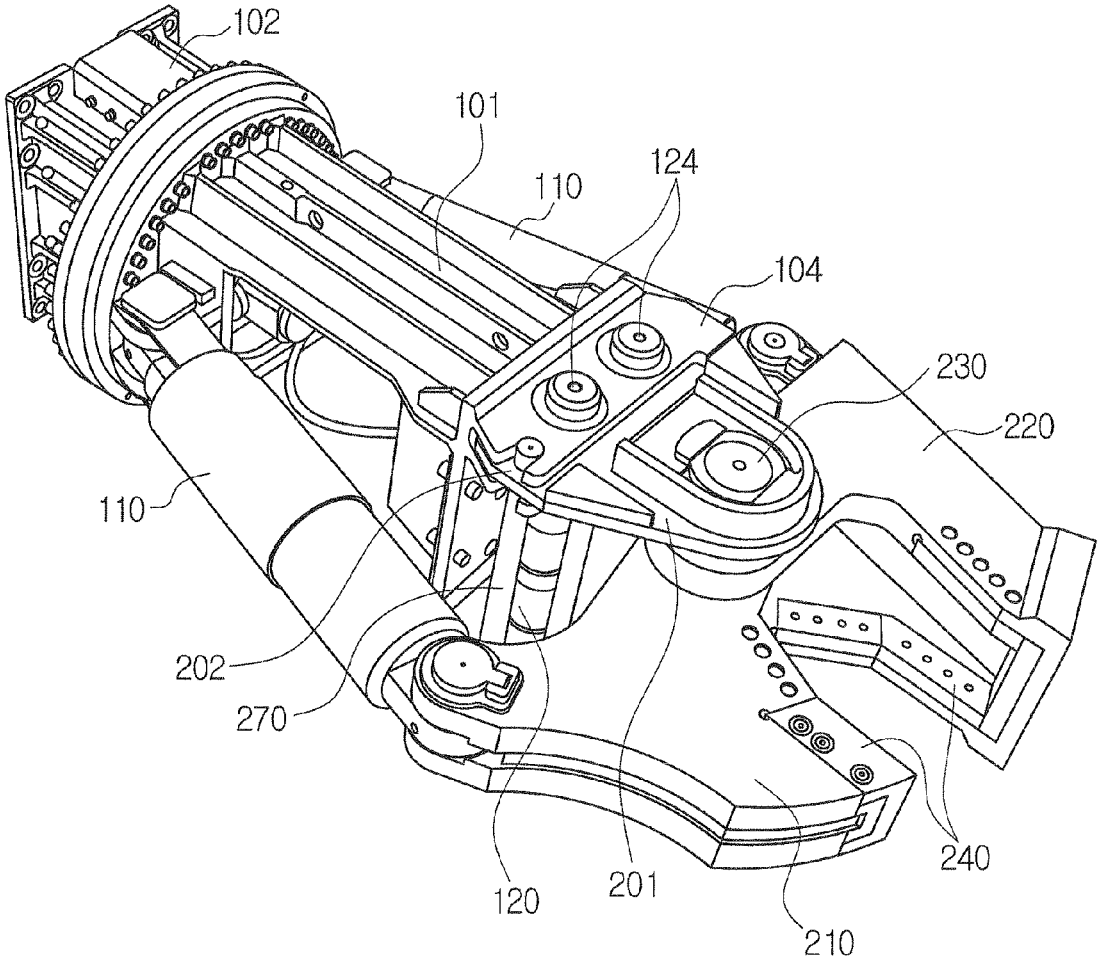
FIG. 5 is a perspective view illustrating an attachment according to a preferred embodiment of the present invention.
Figure 6:
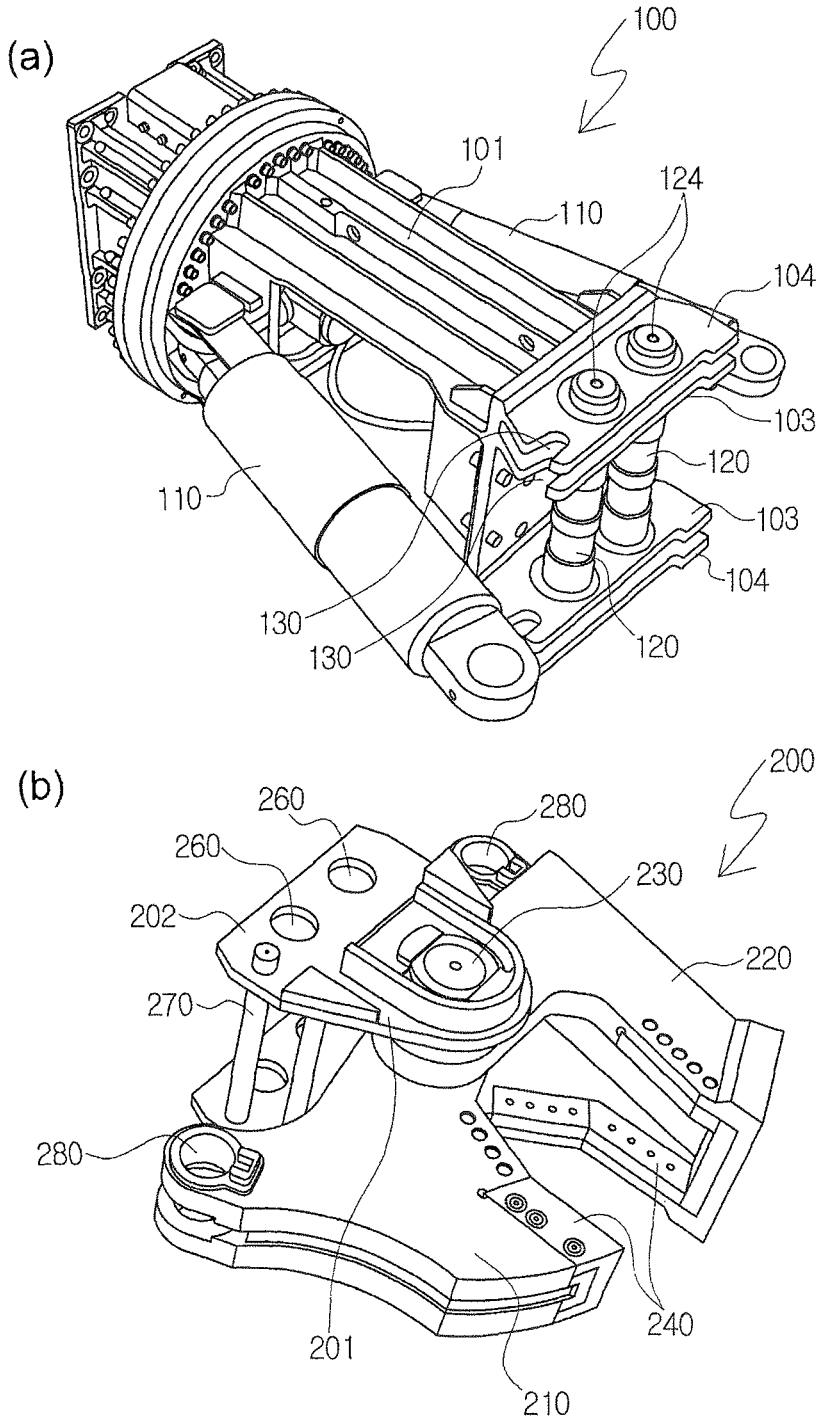
FIG. 6 is a perspective view illustrating an attachment according to a preferred embodiment of the present invention in which a main body unit and a jaw unit are separate from each other.

FIG. 5 is a perspective view illustrating an attachment according to a preferred embodiment of the present invention, and FIG. 6 is a perspective view illustrating an attachment according to a preferred embodiment of the present invention in which a main body unit and a jaw unit are separate from each other.

Referring to FIGS. 5 and 6, a pair of lock pins 120 and a pair of operating cylinders 110 are mounted on a main body unit frame 101.

In this embodiment, the operating cylinders 110 are provided in pairs, but the inventive attachment may include only a single operating cylinder depending on the structure of a crusher/shear. The lock pins 120 and the operating cylinders 110 are constructed to be moved in an extendable and retractable manner by being supplied with oil pressure from construction heavy equipment. In addition, each of the lock pins 120 includes a lock pin stop 124 mounted at both ends thereof.

The main body unit frame 101 includes an equipment connecting section 102 configured for connection with the construction heavy equipment, a first support 103 configured to support the lock pin stop 124 when the lock pins 120 are retracted, a second support 104 configured to support the lock pin stop 124 or the lock pin piston when the lock pins 120 are extended, and a hook pin-receiving portion 130 in the form of an open slot, formed at one side of the main body unit frame.

The equipment connecting section 102 may include a connection section which can be directly connected with the construction heavy equipment, and a connection section which can be connected with the construction heavy equipment by means of a quick coupler.

The jaw unit 200 includes a pair of jaws 210 and 220, each of which includes an operating cylinder connecting section 280 formed at one side thereof for connection with the operating cylinder 110 and a blade 240 formed at the other side thereof. The pair of jaws 210 and 220 is joined to a jaw unit frame 201 by a jaw pin 230 for supporting the pivotal rotation of the jaws 210 and 220. In addition, the jaw unit 200 includes a hook pin 270 mounted to a jaw unit frame 201 so as to be insertedly hooked in the hook pin-receiving portion 130 of the main body unit 130.

Further, the jaw unit frame 201 includes a third support 202 interposed between the first and second supports 103 and 104 and having a pair of insertion holes 260 formed therein so as to allow the pair of lock pins 120 to be inserted thereto, respectively.

Figure 7:
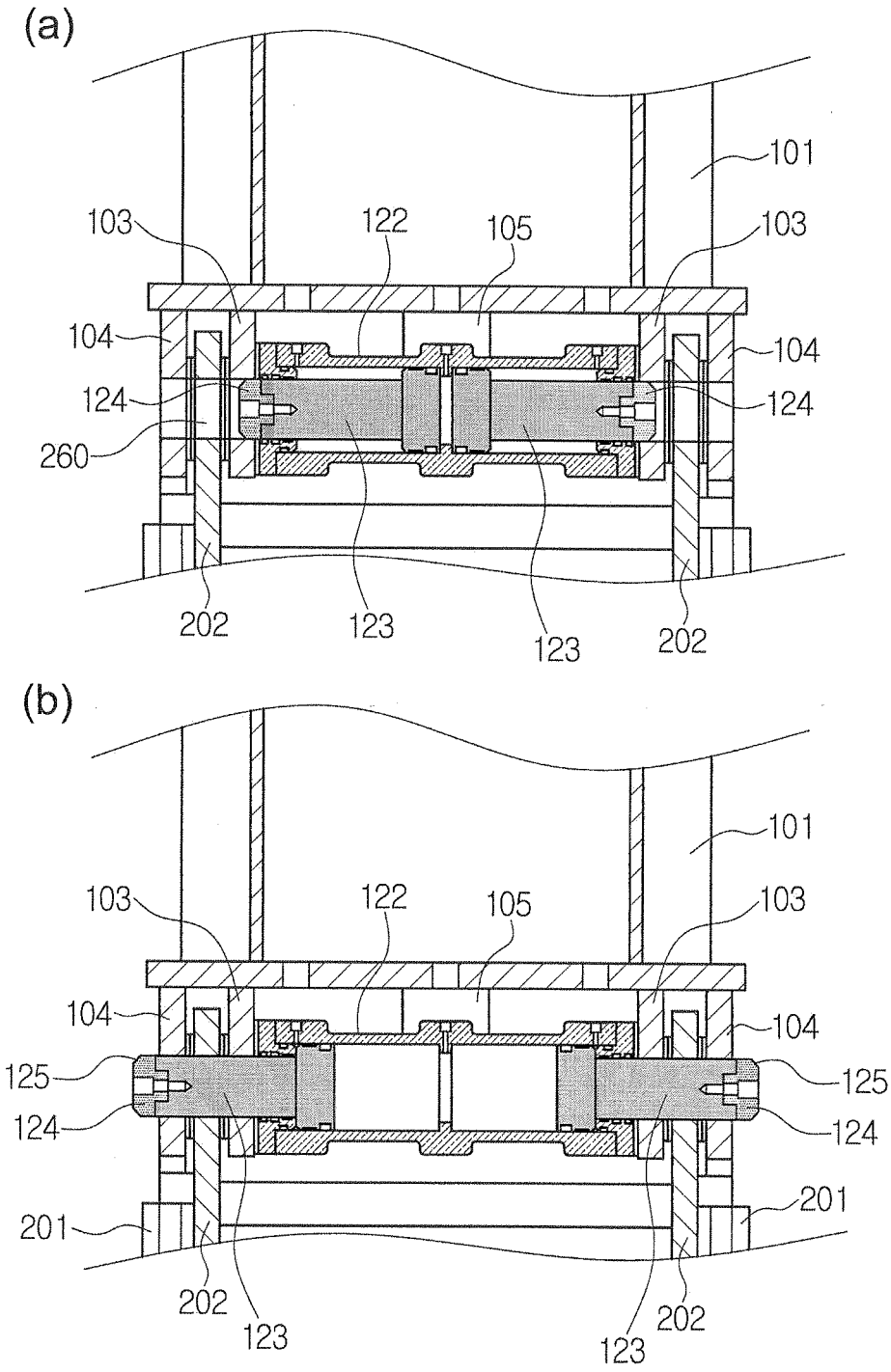
FIG. 7 is a view illustrating the engagement between and the operation of the lock pin and the main body unit/the jaw unit.

FIG. 7 illustrates the engagement between and the operation of the lock pin cylinder 122/the lock pin piston 123 and the main body unit/the jaw unit.

Figure 1:
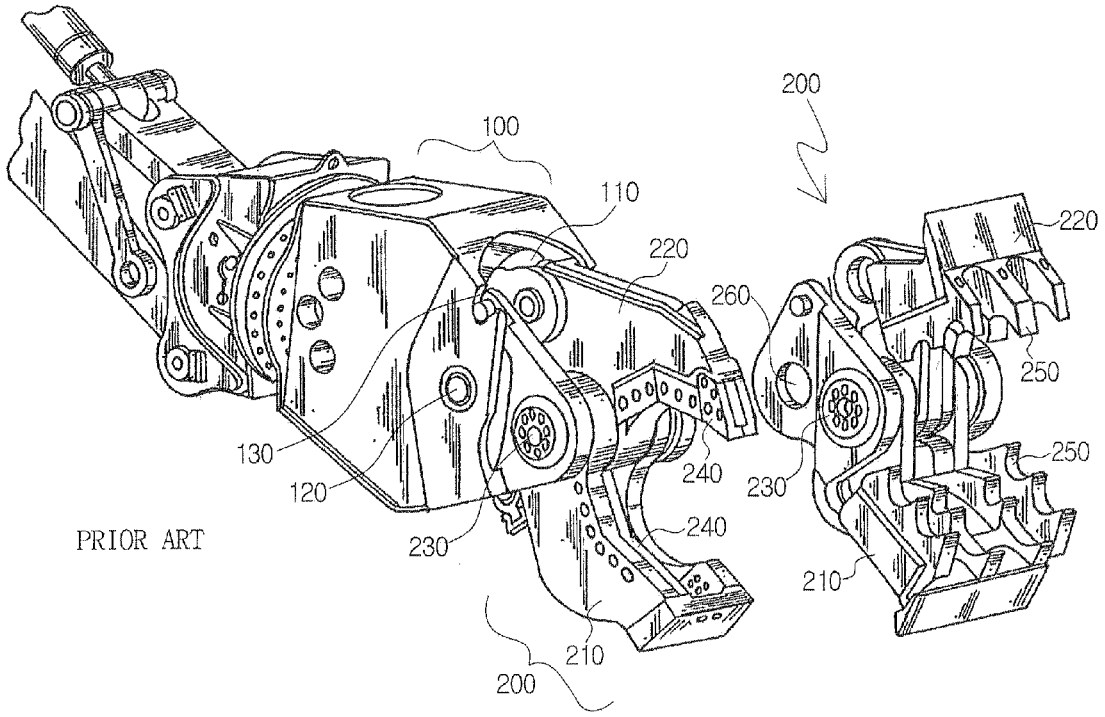
FIG. 1 is a perspective view illustrating an outer appearance of an attachment according to the prior art.
Figure 2:
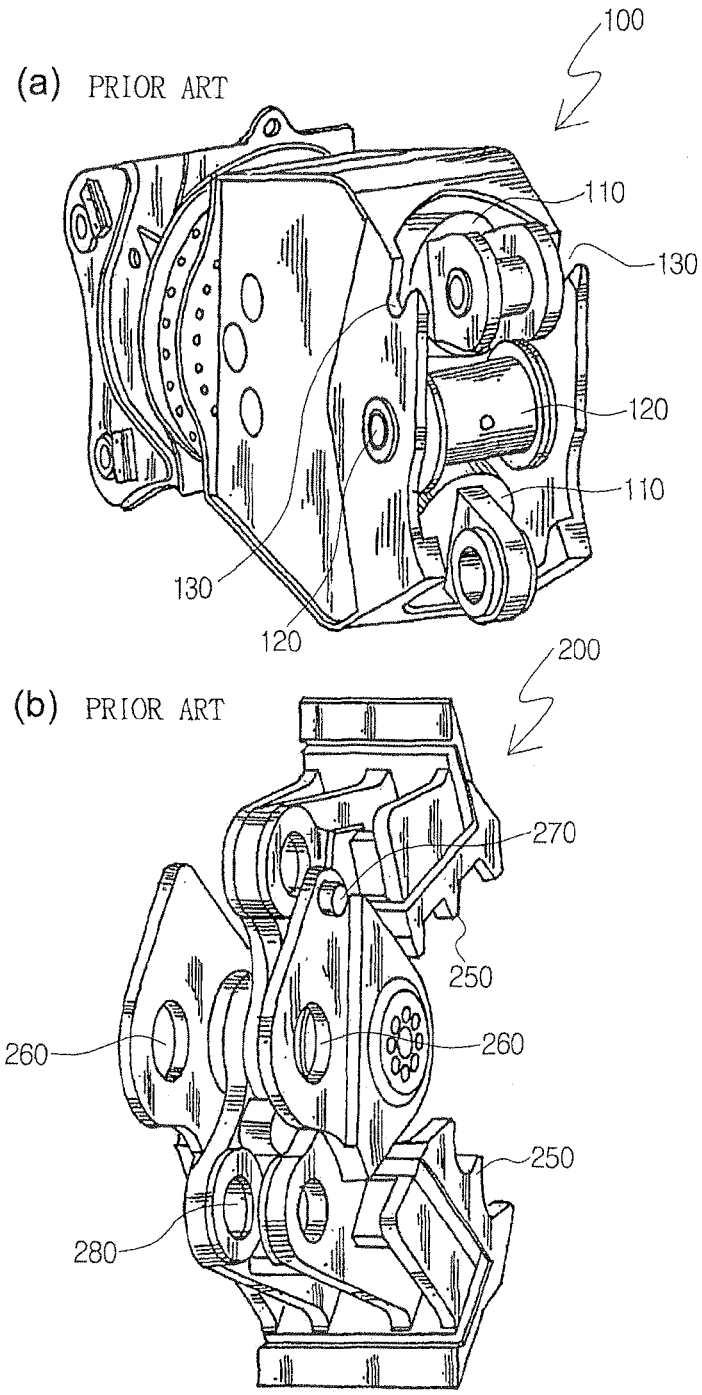
FIG. 2 are perspective views illustrating a main body unit and a jaw unit of the attachment according to the prior art.
Figure 3:
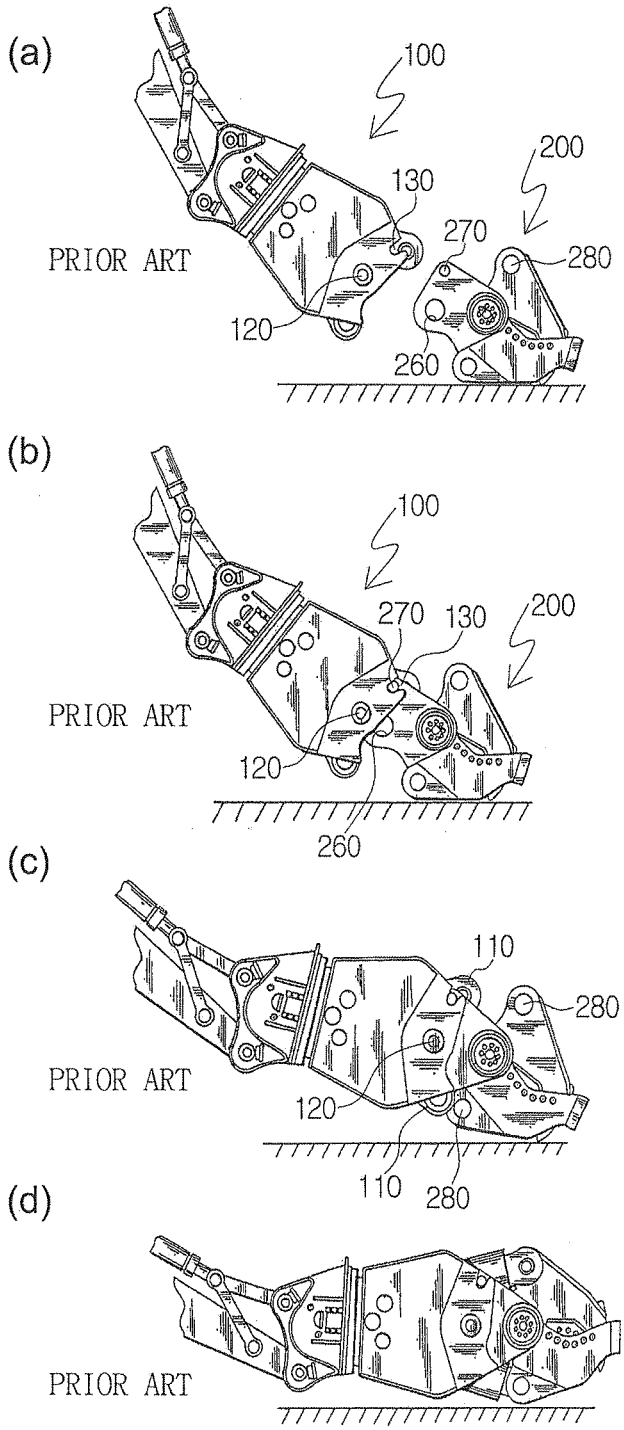
FIG. 3 is a conceptual view illustrating a process in which the jaw unit is engaged with the main body unit in the attachment according to the prior art.
Figure 4:
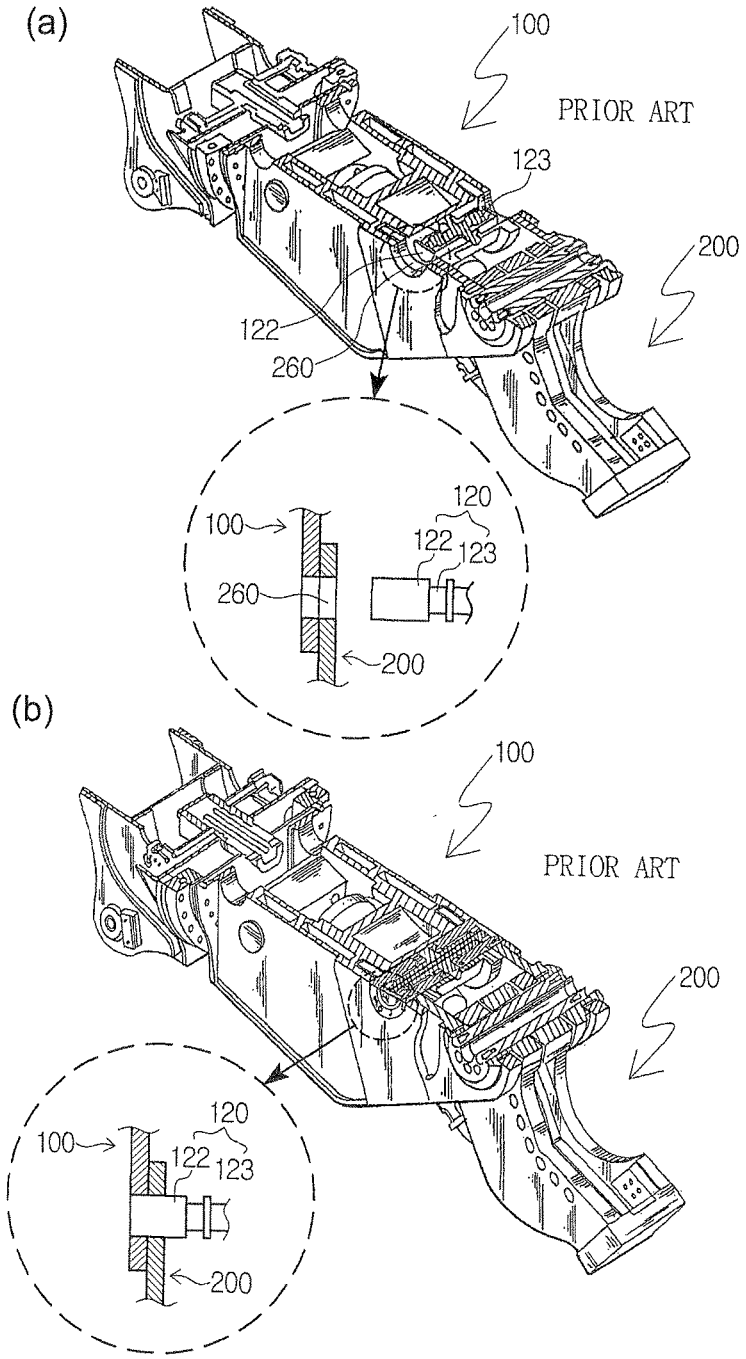
FIG. 4 is a perspective view illustrating the engagement relationship between the main body unit and the jaw unit in the attachment according to the prior art.

Referring to FIG. 7, the attachment is operated in a such fashion that the hook pin is insertedly hooked in the hook pin-receiving portion, and the main body unit is pivotally rotated to align the centers of the lock pins and the insertion holes with each other as shown in FIG. 3(*c*). The lock pin stop 124 is fastened to a distal end of the lock pin piston 123 by means of a bolt or the like. The diameter of the lock pin stop 124 is required to be equal to that of the lock pin piston 123, but has an inclined face 125 partially formed at a peripheral edge of an outer end thereof, which is opposed to an inner end thereof joined to the lock pin piston.

FIG. 7(*a*) shows a state in which the lock pin is maximally retracted, and FIG. 7(*b*) shows a state in which the lock pin is maximally extended.

The lock pin cylinder 122 is fastened to a lock pin support 105 by means of a bolt or the like, and is mounted on the main body unit frame 101. The conventional attachment has a problem in that since the lock pin is supported by only the lock pin support, it is deviated from its normal position. On the other hand, the present invention has an advantage in that since the lock pin stop 124 mounted at a distal end of the lock pin piston 123 is supported by the first support 103 of the main body unit frame 101 in a state in which the lock pin is maximally retracted, the lock pin is not deviated from its normal position.

In addition, even though the centers of the lock pins 120 are not aligned with those of the insertion holes 260 upon the insertion of the lock pins 120 into the insertion holes 260 of the third support 202 of the jaw unit frame 201, each lock pin stop 124 includes an inclined face 125, and thus the jaw unit frame 201 is moved to align the centers of the lock pins 120 with those of the insertion holes 260 so that the lock pins can be easily inserted into the insertion holes 260. Besides, when the lock pins collide against the boundary portions of the insertion holes 260 and the third support 202 during the insertion of the lock pins 120 into the insertion holes 260, the lock pin stops 124 are damaged. If such damage causes a problem, only the problematic lock pin stops 124 can be replaced with new ones even without any replacement of expensive lock pins, thereby improving durability of the lock pins.

As shown in FIG. 7(*b*), when the lock pins 120 are maximally extended through the insertion holes 260, the lock pin pistons 123 cause the first and second supports 103 and 104 to be engaged with the third support 202 so that the connection between the main body unit 100 and the jaw unit 200 can be smoothly maintained. In the present invention, since the main body unit 100 includes the lock pins in pairs, the relative pivotal rotation between the main body unit the jaw unit occurs no longer, so that no damage is caused to the hook pin-receiving portion 130 and the hook pin 270. In addition, the present invention includes the first and second supports 103 and 104 and allows the main body unit 100 and the jaw unit 200 to be engaged with each other in such a fashion that the third support 202 is interposed between the first and second supports 103 and 104. Thus, the deformation of the lock pin piston 123 positioned between the first, second, and third supports 103, 104 and 202 is suppressed, which also exhibits an effect of suppressing the relative deformation between the lock pin piston 123 and the lock pin cylinder 122, thereby improving durability of the lock pins.

As described above, according to the present invention, a load can be prevented from being exerted to a hook pin during the operation of the attachment after replacement of jaw units, the lock pin can endure its self-weight, and the extendable and retractable movement of the lock pin can be guided, making it easy to replace jaw units. In addition, since only the lock pin stop can be replaced with new one even though the front end of the lock pin is abraded, durability of the lock pin is ensured.

While the present invention has been described in connection with the optimum exemplary embodiments illustrated in the drawings, the terminology used herein is for the purpose of describing particular embodiments only and is not intended to limit the meaning of the invention or limit the scope of the invention disclosed in the claims. Also, it is to be understood that various equivalent modifications and variations of the embodiments can be made by a person having an ordinary skill in the art without departing from the spirit and scope of the present invention. Therefore, various embodiments of the present invention are merely for reference in defining the scope of the invention, and the true technical scope of the present invention should be defined by the technical spirit of the appended claims.

What is claimed is:

1. An attachment having interchangeable jaws, comprising:

a main body unit connected to heavy construction equipment; and a jaw unit connected to the main body unit, wherein the main body unit comprises: a pair of lock pins configured to be moved in an extendable and retractable manner by being supplied with oil pressure from the construction heavy equipment, each of the locking pins including a lock pin stop mounted at both ends of corresponding locking pin; and at least one operating cylinder configured to operate the jaw unit by being supplied with oil pressure from the construction heavy equipment, the lock pins and the least one operating cylinder being mounted on a main body unit frame, wherein the main body unit frame comprises: an equipment connecting section configured for connection with the construction heavy equipment; a first support configured to support the lock pin stop mounted at both ends of the corresponding locking pin when the lock pins are retracted; a second support configured to support the lock pin stop mounted at both ends of the corresponding locking pin or a lock pin piston when the lock pins are extended; and a hook pin-receiving portion formed at one side of the main body unit frame, wherein the jaw unit comprises: a pair of jaws, each of which includes an operating cylinder connecting section formed at one side thereof for connection with the operating cylinder and a blade or spike formed at the other side thereof; a jaw pin configured to support the pivotal rotation of the jaws; and a hook pin engagingly mounted to a jaw unit frame so as to be insertedly hooked in the hook pin-receiving portion, and wherein the jaw unit frame comprises a third support interposed between the first and second supports and having a pair of insertion holes formed therein so as to allow the pair of lock pins to be inserted thereto, respectively.

2. The attachment according to claim 1, wherein the lock pin stop includes an inclined face partially formed at a peripheral edge of an outer end thereof, which is opposed to an inner end thereof joined to the lock pin piston.

* * * * *